US005193528A

United States Patent [19]

Iwamoto et al.

[11] Patent Number: 5,193,528

[45] Date of Patent: Mar. 16, 1993

[54] HAND-HELD VIBRATORY MASSAGER

[75] Inventors: Hironori Iwamoto, Oomi; Kuniharu Ichikawa, Kushiyama; Taro Mochida, Hirakata; Teruhisa Innami, Hikone, all of Japan

[73] Assignee: Matsushita Electric Works, Ltd., Osaka, Japan

[21] Appl. No.: 637,816

[22] Filed: Jan. 7, 1991

[30] Foreign Application Priority Data

Jan. 13, 1990 [JP] Japan ..... 2-5944

[51] Int. Cl.[5] ..... A61H 1/00

[52] U.S. Cl. ..... 128/36; 128/24.1; 128/44; 16/115

[58] Field of Search ..... 128/24.2, 32-36, 128/41, 44, 45, 46, 48-52, 59-62 R, 24.1; 16/115, 110 R; 403/104, 107, 108

[56] References Cited

U.S. PATENT DOCUMENTS 4,354,689 10/1982 Perego ..... 16/115 X
4,508,108 4/1985 Miyaoka ..... 128/62 R
4,768,258 9/1988 Langenstein ..... 16/115
4,825,853 5/1989 Iwamoto et al. ..... 128/34 X
4,827,914 5/1989 Kamatawa ..... 128/34
4,958,628 9/1990 Iwamoto et al. ..... 128/34 X

FOREIGN PATENT DOCUMENTS 54-109290 8/1979 Japan .

*Primary Examiner*—Mickey Yu
*Assistant Examiner*—Brian E. Hanlon
*Attorney, Agent, or Firm*—Stevens, Davis, Miller & Mosher

[57] ABSTRACT

A hand-held extensible vibratory massager comprises a hand grip to be grasped by a hand of a user, a self-contained vibration applicator generating a vibratory massaging motion. An arcuately extensible arm interconnects the hand grip and the applicator so that the applicator is movable along an arcuate path from a normal position adjacent the hand grip to an extended position away therefrom, facilitating to locate the applicator on a portion of the body over an extended range with enhanced operability.

16 Claims, 11 Drawing Sheets

HAND-HELD VIBRATORY MASSAGER

BACKGROUND OF THE INVENTION

1. Field of the Invention

The present invention relates in general to a hand-held vibratory massager, and more particularly to a vibratory massager with an arcuately extensible arm interconnecting a grip and a self-contained vibratory applicator.

2. Description of the Prior Art

As disclosed in Japanese Early Patent Publication (Kokai) No. 54-109290, there has been already proposed a hand-held vibratory massager with an extensible straight arm interconnecting a hand grip and a self-contained vibration applicator. Such extensible prior art massager is advantageous in locating the applicator over a wide area of a user's body, including thigh, knee, leg, foot, and back by suitably extending the straight arm. However, since the applicator is required to be continuously pressed against a selected portion of the body, this prior art vibrator with the straight extensible arm is only successful in providing a massaging action to the front of the body where both hands of the user are available for holding the vibrator and at the same time for applying sufficient force to continuously press the applicator to the selected portion. Such continuous sufficient pressing force is normally obtained by holding the end of the hand grip by one hand and supporting the hand grip at a portion spaced from the end by the other hand, and then by pivoting the grip end by the one hand about the spaced portion supported by the other hand in a lever-like system. In this sense, the prior art massager even with its arm extended is practically difficult to use to give a massaging action to a portion, such as the back of the user, where only one hand of the user is available and therefore both hands are not available to effect the above lever-like system for producing sufficient pressing force at the applicator. In this condition, the user is required instead to bend or twist the wrist to produce a torque about the end of the hand grip in order to obtain a sufficient pressing force at the applicator. That is, as shown in FIG. 21, when massaging the back or waist, the user has no way but to hold the massager by one hand and is therefore required to twist the hand grip for producing a torque required to place the applicator to the desired portion at a sufficient pressing force. Assuming that the user gives a constant torque T, and when the massager is extended from a normal position of placing the applicator z a distance D1 away from the hand holding the grip 1 to an extended position of placing the applicator 2 an increased distance D2 away from the same, the applicator 2 is given at its normal and extended positions respectively pressing forces $W_1$ ($=T/D_1$) and $W_2$ ($=T/D_2$). As apparent from the above, pressing force $W_2$ at the extended position is eventually less than $W_1$ as $D_2>D_1$. This means that as the vibrator extends, the resulting pressing force will be reduced, which invalidates the extensible feature of the vibrator. In other words, in order to keep providing sufficient pressing force at the applicator in its extended position, the user has to increase the torque with attendant accumulation of fatigue of the wrist, making it difficult to continue the massaging.

SUMMARY OF THE INVENTION

The above problem has been eliminated in the present invention which provides an improved hand-held vibration massager. The massager in accordance with the present invention comprises a hand grip to be grasped by a hand of a user, a self-contained vibration applicator, and an extensible arcuate arm interconnecting the hand grip and the applicator along an arcuate path. By provision of the arcuately extensible arm, it is readily possible to place the applicator over a wide range of the user's back while keeping the hand grip in front of the user's body so that the applicator can be kept pressed against a desired portion of the user's back at sufficient force simply by pulling the hand grip forwardly by one hand of the user, yet keeping the whole vibrator assembly compact by contracting the arm when it is not used.

Accordingly, it is a primary object of the present invention to provide an improved hand-held vibratory massager which is capable of placing the applicator over a wide area while permitting the user to hold the vibrator by one hand in a convenient manner so as to keep the applicator pressed against by sufficient pressing force to a desired portion, assuring an effective and comfortable massaging action.

The extensible arcuate arm comprises an inner arcuately elongated tube extending from the hand grip and an outer arcuately elongated tube extending from the vibration applicator. The inner tube is telescopically slidable in the outer tube so that the arcuate arm can vary its length along the arcuate path. The inner tube is formed in its exterior surface with a plurality of indentations spaced along the length of the inner tube. The outer tube carries an adjustor which is engageable selectively with the indentation, for latching the outer tube into a selective position relative to the inner tube. The adjustor is in the form of a generally semi-circular configuration with an operator knob at its middle and opposed spring legs integrally extending from the operator knob in the opposite directions between the outer and inner tubes. The operator knob projects outwardly through the outer tube to be accessible by the hand of the user. The spring legs are formed at their free ends respectively with shoes which are spring biased into the indentations. Each spring leg is also formed intermediate between the shoe and the operator knob with a fulcrum projection abutting against the interior surface of the outer tube. Upon the operator knob being pushed inwardly, the opposed spring legs are forced to pivot about the fulcrum projections to expand away from the exterior surface of the inner tube for disengaging the shoes out of the indentations, thereby allowing the slidable movement of the outer tube relative to the inner tube.

It is therefore another object of the present invention to provide a hand-held vibratory massager which is capable of easily adjusting the arcuate length of the arm.

Preferably, the spring legs are each integrally formed at a portion opposite of the fulcrum projection with a slider projection for slidable contact with the outer surface of the inner tube. Thus, the adjustor itself can also act as a slider for smooth movement of the inner tube relative to the outer tube, serving to reduce a number of components required to effect the sliding movement between the inner and outer tubes, which is therefore a further object of the present invention.

The inner tube is formed with a plurality of ledges slightly projecting on its circumference at spaced locations along the length thereof in correspondence to the locations of the indentations. The adjustor further comprises a clip which is a separate member from the spring legs and carried together therewith by the outer tube. The clip is disposed between the inner and outer tubes to extend over an exterior circumference of the inner tube not covered by the spring legs, and is formed integrally with slider projections which are slidable along the exterior surface of the inner tube. The slide projections are brought into pressed contact with the ledges when the shoes of the adjustor are engaged into the indentations so as to tightly hold the inner tube within the outer tube at the adjustor. In this manner, the outer tube can be latched into position by means of the spring legs and also by means of the slider projections both of which are spaced circumferentially so as to effect latching tightly and stably without causing undesirable shaking or jittering at the connection between the tubes when subjected to counter-vibration from the applicator, which is therefore a still further object of the present invention.

The adjustor is provided at an end of the outer tube remote from the applicator, while the inner tube is provided at its free end remote from the hand grip with a slider ring which extends circumferentially about the inner tube and has circumferentially spaced slide projections for sliding contact with the interior surface of the outer tube. Thus, the inner tube can be always supported at two longitudinally spaced portions by means of the adjustor and the slider ring irrespective of the lengthwise position of the inner tube relative to the outer tube, assuring to stably hold the outer and inner tubes at any selected position between the normal contracted position and fully extended position of the arcuate arm.

The outer tube is formed with a plurality of ledges or lands slightly projecting on the interior surface of thereof at spaced locations along the length thereof in correspondence to the indentations. The slide projections of the slider ring brought into pressed contact with the lands of the outer tube, respectively when the shoes of the adjustor are engaged into the indentations. Therefore, the slider also acts to tightly hold the inner tube against the outer tube at the selected position, which is in cooperation with the like pressed contact at the adjustor to enhance stability of holding the inner and outer tubes at the selected position and therefore eliminate jittering at the connections between the tubes.

The outer tube is formed on its interior surface with a plurality of guide rails extending along the length thereof for engagement with fins projecting on the exterior surface of the inner tube. With this arrangement, the inner and outer tubes can be prevented from rotating relative to each other and be therefore assured of a consistent telescopic operation of varying the length of the arcuate arm, which is therefore a still further object of the present invention.

In another embodiment, the inner tube is configured to have a circular exterior circumference centered on a first center axis, while the outer tube is provided at its end remote from the applicator with a sleeve which has a circular interior circumference centered commonly on the first center axis and which is in slidable contact with the exterior circumference of the inner tube. Rotatively supported around the sleeve is a fastener ring which includes a grip flange having inner circular perimeter in slidable contact with the exterior circumference of the inner tube. The inner circular perimeter of the grip flange is centered on a second center axis which is in eccentric relation to the first center axis such that the inner circular perimeter is kept in loose contact with the exterior circumference of the inner tube when the fastener ring is at one angular disposition about the first center axis for allowing the fastener ring to be slidable together with the sleeve along the length of the inner tube. The inner circular perimeter of the grip flange comes into pressed contact against the exterior circumference of the inner tube when the fastener ring is rotated from the angular disposition about the first center axis for tightening the fastener ring on the inner tube, disabling the sliding movement between the sleeve and the inner tube. Thus, it is possible to tighten the fastener ring at any desired portion along the length of the inner tube, permitting the operator to vary the length of the arcuate arm continuously in a stepless manner.

It is therefore a still further object of the present invention to provide a hand-held vibratory massager in which the arcuate arm can be adjusted in length continuously in a stepless manner.

These and still other objects and advantages of the present invention will become more apparent from the following description of the embodiments of the present invention when taken in conjunction with the attached drawings.

DETAILED DESCRIPTION OF THE PREFERRED EMBODIMENTS

Figure 1:
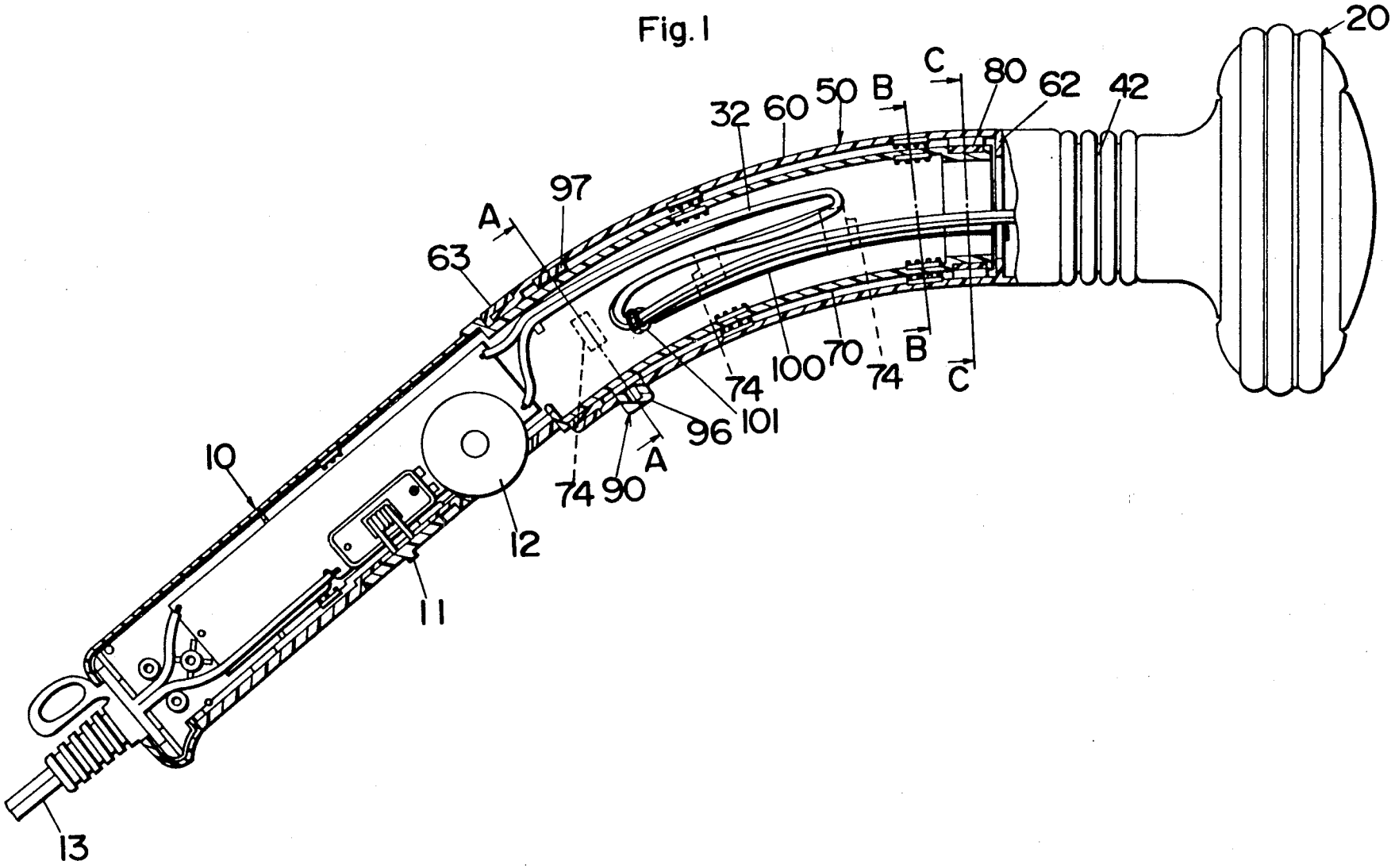
FIG. 1 is a sectional view, partly in elevation, of a hand-held vibratory massager in accordance with a first embodiment of the present invention.

Referring to FIG. 1, a hand-held vibratory massager in accordance with a first embodiment of the present invention is shown to comprise an elongated hand grip 10 and an applicator 20 which are interconnected by means of an extensible arcuate arm 50. The hand grip 10 is an elongated straight hollow tube provided with a main switch handle 11 and a control dial 12 for adjusting the rate of vibration effected by the applicator 20. A power cord 13 extends from the rear end of the hand grip 10 for energization of an electric motor 30 mounted Within the applicator 20.

Figure 2:
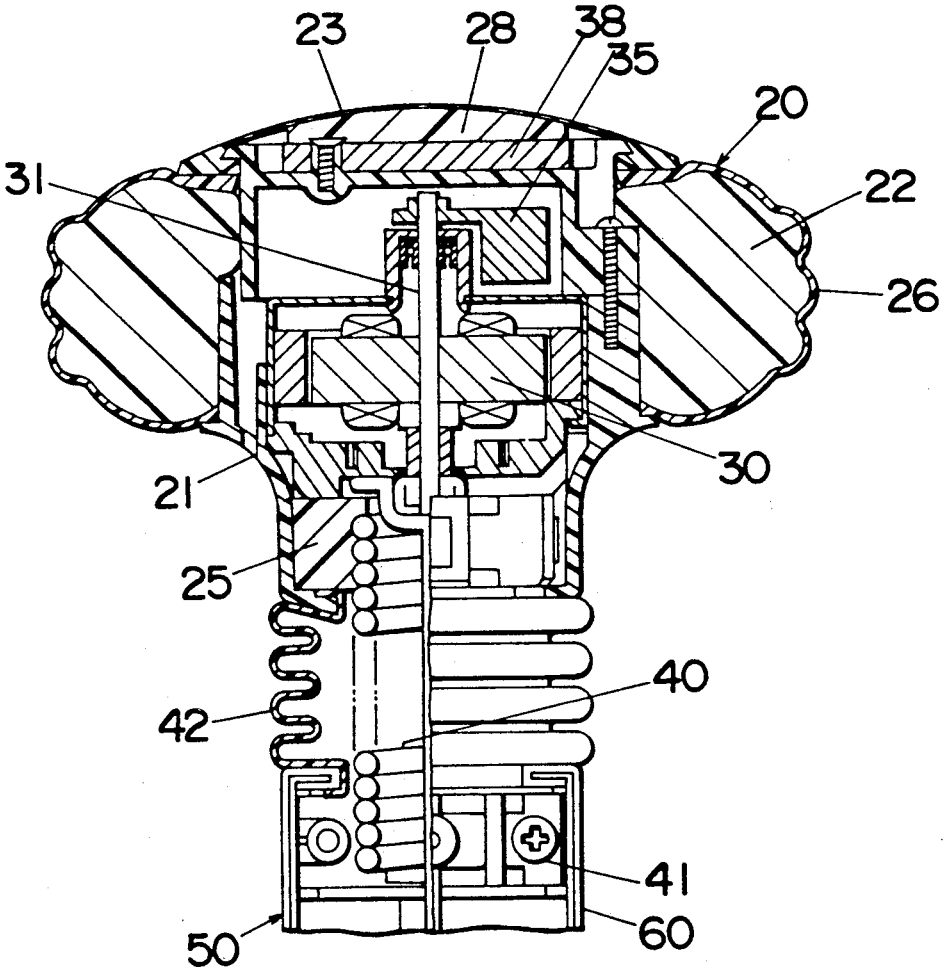
FIG. 2 is a sectional view of an applicator of the above massager.

As shown in FIG. 2, the applicator 20 comprises a core barrel 21, a cushioning annulus 22 surrounding the barrel 21, and a convexedly shaped end plate 23 covering the top face of the barrel 21. The motor 30 is mounted Within the core barrel 21 together with a flyweight 35 so that the applicator 20 is made as a self-contained vibration-generating unit. Fixed in a narrow bottom end of the core barrel 21 is a ring 25 on which the motor 30 is supported with its output shaft 31 extending in coaxial alignment with a center axis of the applicator 20. The flyweight 35 is connected to end of the output shaft 31 in an eccentric relation thereto such that it rotates thereabout for producing vibrations transverse to the axis of the output shaft 31 Or the center axis of the applicator 20. The applicator 20 thus constructed is resiliently supported to the arcuate arm 50 by means of a coil spring 40.

One end of the coil spring 40 extends into the ring 25 of the applicator 20 and is threadedly engaged therewith, while the other end of the coil spring 40 extends into the end of the arcuate arm 50 where it is secured by means of a clamp member 41. A corrugated cover 42 surrounds the coil spring 40 between the applicator 20 and the arcuate arm 50 with its opposite ends connected respectively to the applicator 20 and the arm 50. This resilient coupling permits the applicator 20 to move substantially in all directions with respect to the arm 50 in a limited extent, so that the applicator 20 can be brought into an optimum angular position with respect to the arm 50 during the massaging treatment. The annulus 22 of the applicator 20 is made of a cushioning material, for example, foamed polyethylene covered by a soft shell 26 which is connected at its inner ends to the core barrel 21 and is formed on its exterior with a number of circumferentially extending ribs. The side face of the annulus 22 including the ribs serves to apply a tapping massage effect upon a selected body portion against which it is placed. The convexedly shaped end plate 23 is made of relatively hard plastic material and extends over a cushioning material 28 with its peripheral end hooked to the end of the core barrel 21. The end plate 23 is cooperative with the cushioning material 28 to apply a rubbing massage effect upon the body portion as the applicator 20 vibrates. Mounted within the applicator 20 is a counterweight 38 which is offset from the motor 30 and the flyweight 35 along the axis of the output shaft 31 such that a mass center of the entire applicator 20 and a mass center of the flyweight 35 are aligned in a same plane perpendicular to the center axis of the applicator 20, whereby providing provide dynamic balancing of the applicator 20.

Figure 3:
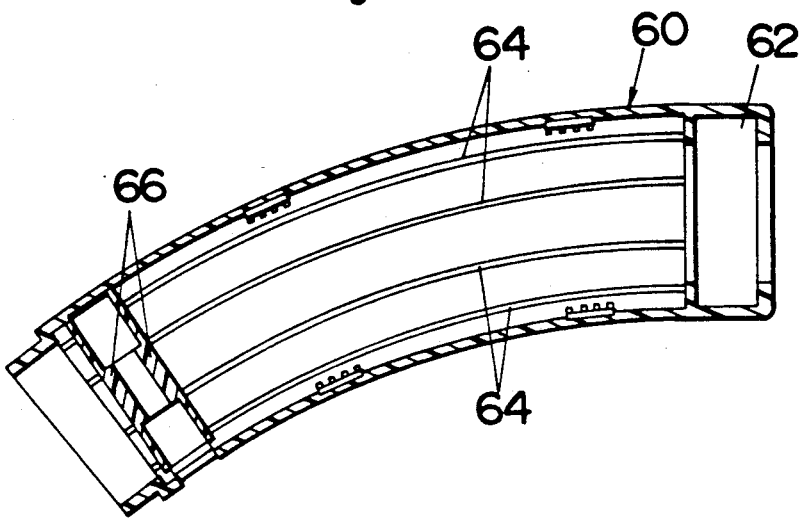
FIG. 3 is a sectional view of an outer tube forming an extensible arcuate arm of the above massager.
Figure 6:
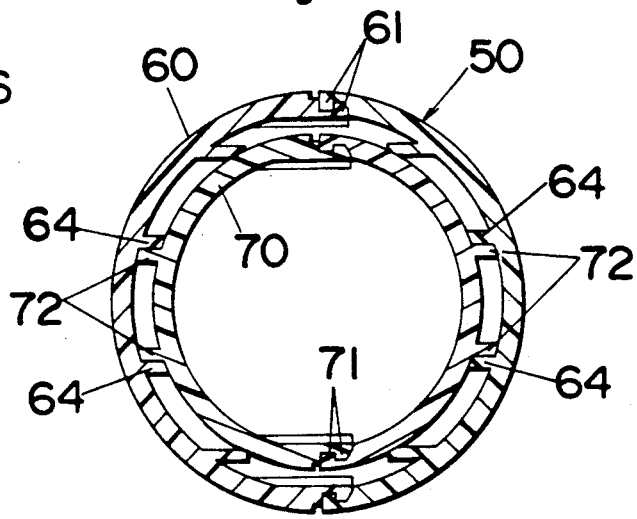
FIG. 6 is a cross-section taken along line B—B of FIG. 1.
Figure 8:
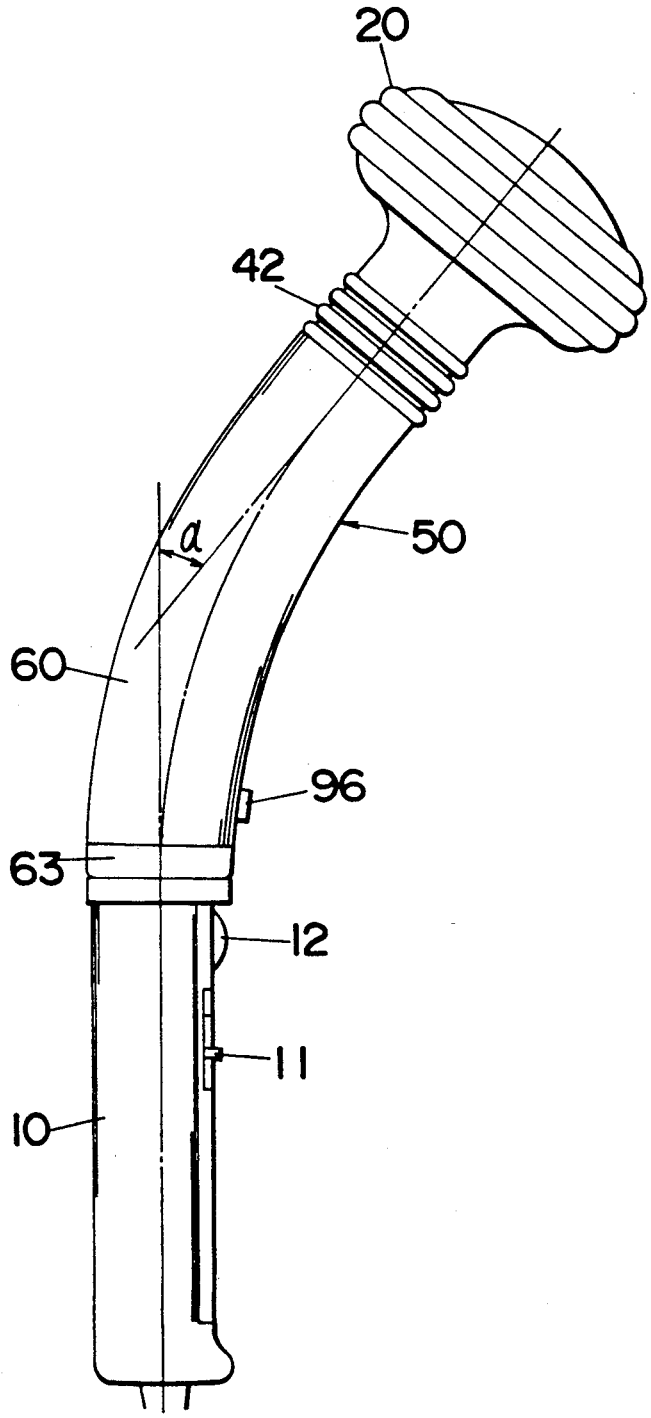
FIGS. 8 and 9 are front views of the massager with its arcuate arm shown respectively at a normal contracted and an extended position.
Figure 9:
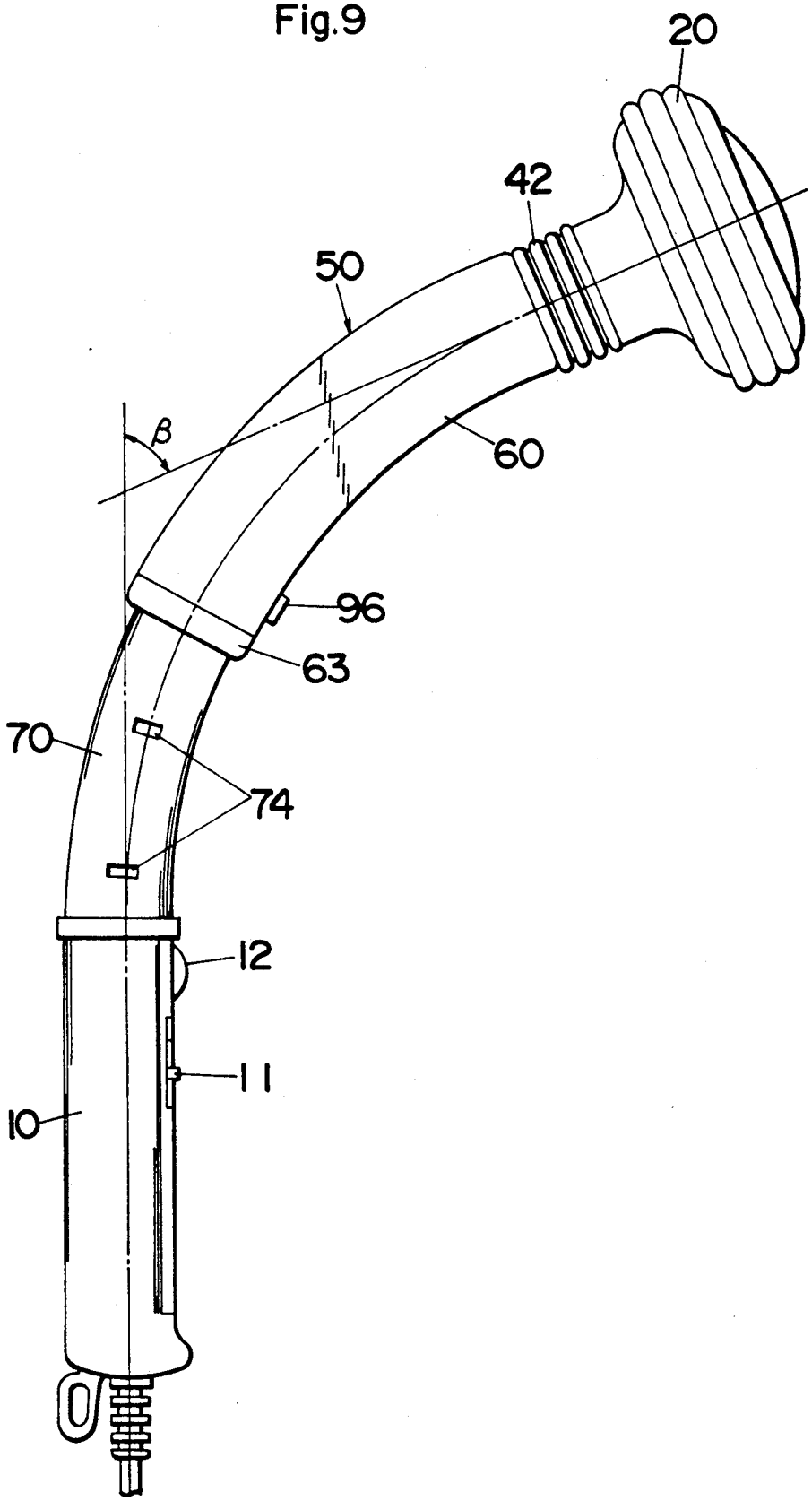

The extensible arcuate arm 50 comprises an arcuately elongated outer tube 60 and an arcuately elongated inner tube 70 which are of circular cross-sections and are telescopically coupled so as to be able to vary the arcuate length of the arm 50 from a normal contracted position of FIG. 8. to an extended position of FIG. 9. The outer and inner tubes 60 and 70 are each composed of two semi-cylindrical halves which are assembled together by engagement of hooks 61 and 71, respectively, as shown in FIG. 6. The outer tube 60 is formed at its one end, as shown in FIG. 3, with a joint section 62 to which the end of the coil spring 40 is secured by means of the clamp member 41 so that the applicator 20 is supported at the end of the outer tube 60. An end cap 63 is fitted around the free end of the outer tube 60. The inner tube 70 is secured at its one end to the hand grip 10 so as to extend therefrom to be telescopically slidable within the outer tube 60. The inner tube 70 may be formed to integrally extend from the hand grip 10. Projecting integrally from the other end of the inner tube 70 remote from the hand grip 10 are two pairs of fins 72 extending arcuately by a short distance along the length of the inner tube 70. These pairs of fins 72 are diametrically opposed to each other about the Circumference of the inner tubes 70, as shown in FIG. 6. A plurality of guide rails 64 are integrally formed on the interior surface of the outer tube 60 to extend along substantially the entire length thereof in circumferentially spaced relation. The fins 72 of the inner tube 70 are kept in slidable engagement with the guide rails 63 during the entire telescopic movement of the inner tube 70 relative to the outer tube 60 in order to prevent the inner tube 70 from rotating within the outer tube 60. At the most extended position of the arm 50, stopper projections 73 on the inner tube 70 at the end of the fins 72 comes into abutting engagement with a member 66 for prevention of accidental escape of the inner tube 70 from within the outer tube 60.

Figure 4:
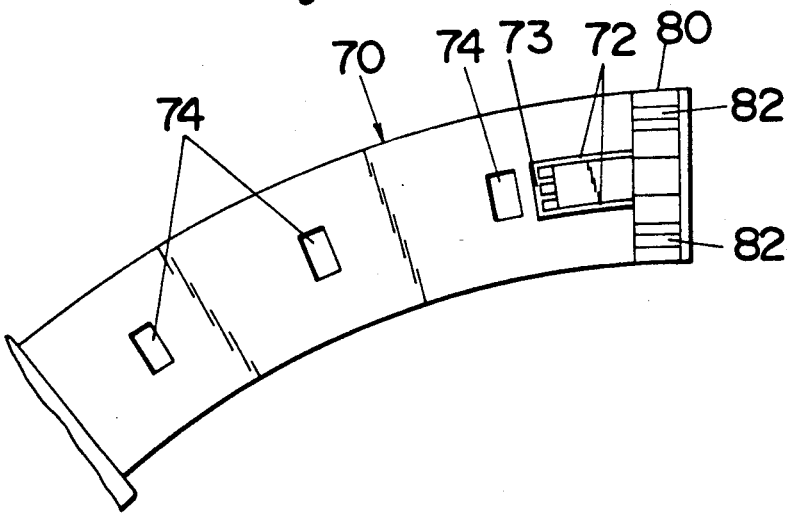
FIG. 4 is a front view of an inner tube forming the extensible arcuate arm.
Figure 7:
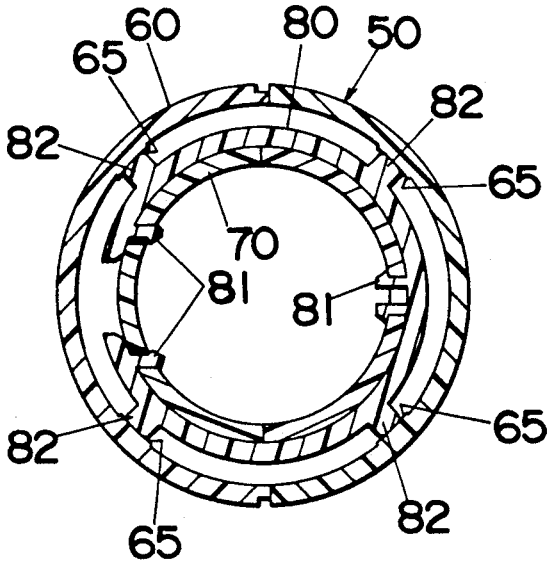
FIG. 7 is a cross-section taken along line C—C of FIG. 1.

As shown in FIGS. 4 and 7, a slider ring 80 made of low friction and wear resistive material is fitted around the free end of the inner tube 70 with inwardly projecting barbs 81 anchored in the wall of the inner tube 70. The slider ring 80 is formed integrally thereon with slide projections 82 which are evenly spaced circumferentially for slidable contact with the inner surface of the outer tube 60 in order to smoothly guide the inner tube 70 within the outer tube 60. As shown in FIG. 7, the inner surface of the outer tube 60 is formed at particular positions along the length thereof with slightly projecting lands 65 which are circumferentially spaced for pressed contact respectively with the slide projections 82. Thus, when the slider ring 80 comes to the particular position, at which the inner tube 70 is latched to the outer tube 60 in a manner as discussed hereinafter, the slide projections 82 ride over the lands 65 into pressed contact therewith such that the inner tube 70 can be kept tight within the outer tube 60, keeping the juncture between the inner and outer tubes 70 and 60 substantially free from the counter-vibration from the applicator 20 for eliminating jittering at this juncture.

Figure 5:
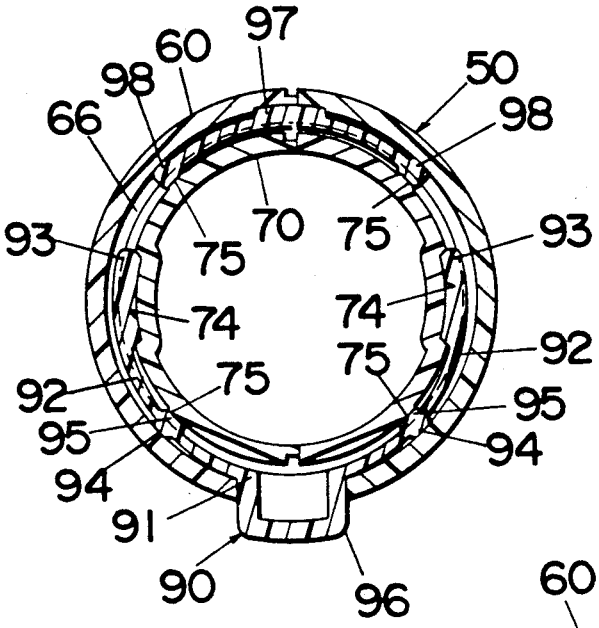
FIG. 5 is a cross-section taken along line A—A of FIG. 1.

As shown in FIG. 4, the inner tube 70 is formed in its diametrically opposed surfaces with a plurality of indentations 74 which are spaced along the length of the inner tube 70 and define the above particular positions for latching the inner tube 70 to the outer tube 60. As shown in FIG. 3, the outer tube 60 is formed at its free end with a pair of retainer ribs 66 which extend circumferentially along the inner surface of the outer tube 60 in longitudinally spaced relation to receive therebetween an adjustor 90. The adjustor 90, thus held at the free end of the outer tube 60, comprises a semi-circular handle member 91 with opposed spring legs 92 on the Opposite sides of an operator knob 96, and a separately formed clip 97 of arcuately curved configuration. As shown in FIGS. 1 and 5, the operator knob 96 projects through the wall of the outer tube 60 to be accessible by the hand of the user, while the spring legs 92 are disposed between the outer and inner tubes 60 and 70 to extend over about a half of circumference of the inner tube 70. The clip 97 is also disposed between the outer and inner tubes 60 and 70 to extend oVer a portion of the circumference in opposed relation to the handle member 91. Each of the Spring legs 92 is formed to have at its free end an inwardly projecting shoe 93 which is spring biased into engagement with corresponding indentations 74 in the inner tube 70 when the adjustor 90 comes to any one of the particular positions along the length of the inner tube 70 for latching engagement between the outer and inner tubes 60 and 70 at any one of the particular positions. Formed intermediate between the shoe 93 and the operator knob 96 is a fulcrum 95 projecting outwardly for point contact with the interior surface of the outer tube 60. The handle member 91 is given enough resiliency so that the opposed spring legs 92 can resiliently expand outwardly about the fulcrum 95 so as to disengage the shoes 93 from the indentations 74 when the operator knob 96 is depressed inwardly. Thus, the latching between the outer and inner tubes 60 and 70 can be released by simply depressing the operator knob 96, permitting the sliding movement therebetween for adjusting the length of the arcuate arm 50. Each of the spring legs 92 is also formed at a portion opposite the fulcrum 95 with slider projection 94 for slidable contact with the interior surface of the outer tube 60, similar to that of the slide projections 82 of the slider ring 80 are with the interior surface of the outer tube 60. Further, the clip 97 is formed at its opposed ends with like slider projections 98 for slidable contact with the exterior surface of the inner tube 70. These slidable projections 95 and 98 are evenly spaced circumferentially in a like fashion as the slide projections 82 of the slider ring 80. In this sense, the adjustor 90 can effect two functions of latching the tubes and of assisting the sliding movement therebetween. It is noted at this point that the inner tube 70 is formed at lengthwise locations corresponding to the indentations 74 with slightly projecting ledges 75 such that the slider projections 95 and 98 come into pressed engagement with the respective ledges 75 when the adjustor 90 latches the outer tube 60 to the inner tube 70, thereby eliminating jittering also at the adjustor 90 between the outer and inner tubes 60 and 70, in much the same manner as at the slider ring 80. Thus, the inner tube 70 can be held tight within the outer tube 60 at two longitudinally spaced portions by means of the adjustor 90 and the slider ring 80 as they are latched, which assures to stabilize the arcuate arm 50 in any of the particular latching positions including the normal contracted position, the most extended position and the intermediate position. As shown in FIG. 1, a rigid wire-like segment 100 extends into the inner tube 70 with its one end secured to the outer tube 60 at the coupling end with the applicator 120. The other end of the segment 100 is coiled to form thereat a guide ring 101 through which a flexible lead 32 extends from the motor 30 in the applicator 20 for electrical connection with an energizing circuit in the hand grip 10. The segment 100 is curved along the arcuate axis of the arm 50 and has a length sufficient to position the guide ring 101 within the inner tube 70 even the arm 50 is fully extended.

Figure 10:
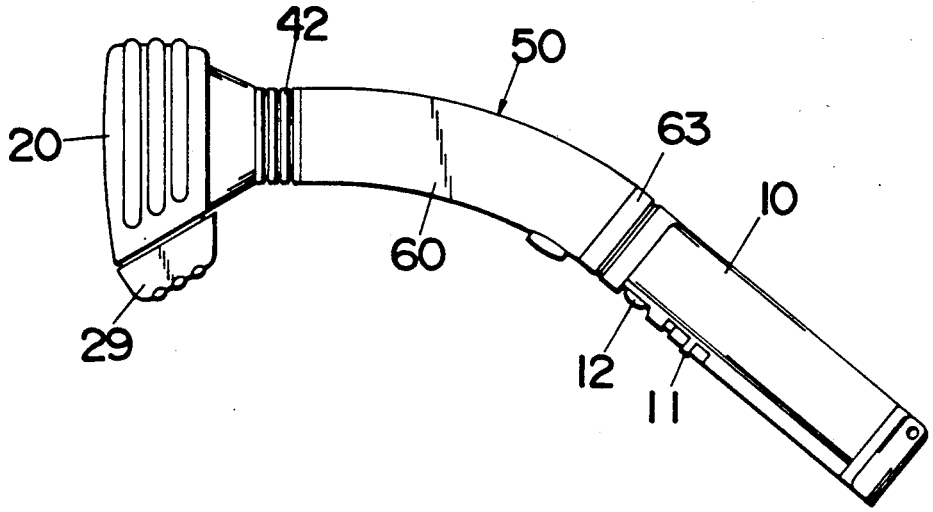
FIGS. 10 and 11 are similar to FIGS. 8 and 9 but illustrate a modified applicator of the massager with its arm shown respectively at normal contracted and extended positions.
Figure 11:
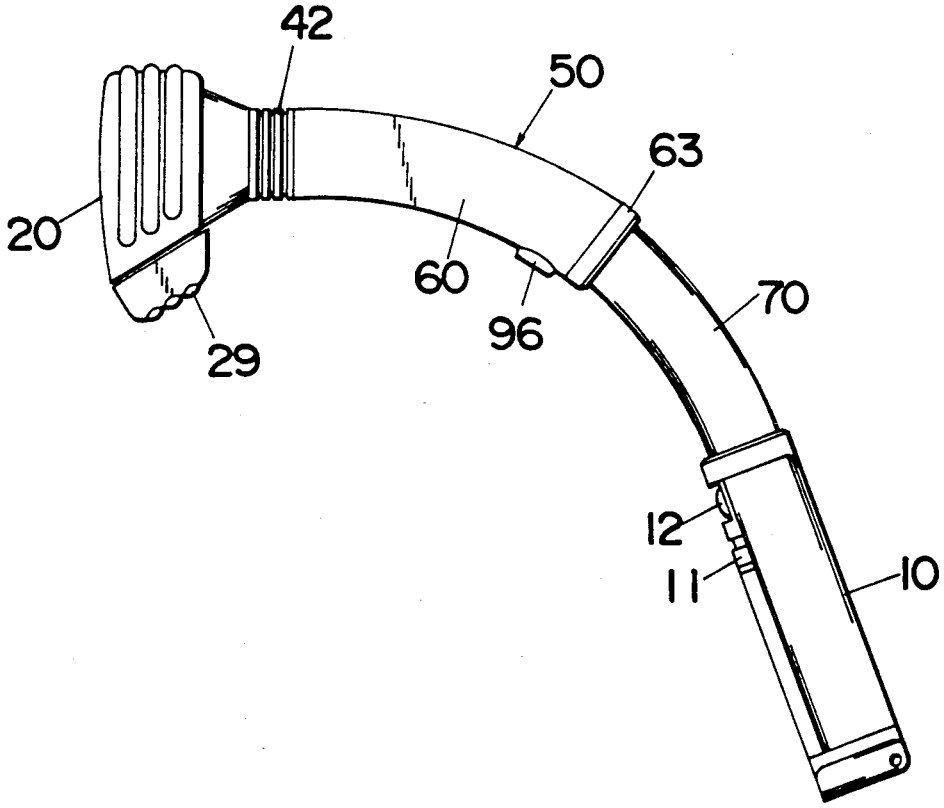

The arcuate arm 50 thus constructed has such a curvature that the applicator 20 has its center axis inclined at an angle $\alpha$ of 40° with respect to that of the hand grip 10 when the arm 50 is in the retracted position of FIG. 8, and inclined at a wider angle $\beta$ of 63° when the arm 50 is in the most extended position of FIG. 9. As shown in FIGS. 10 and 11, the applicator 20 is preferred to have a side pad 29 projecting inwardly of the arcuate path of the arm 50.

Figure 12:
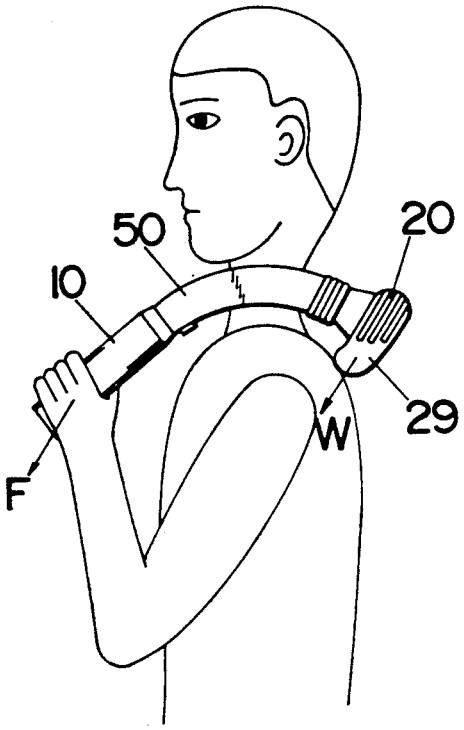
FIGS. 12 and 13 are explanatory views illustrating operations of massaging the back of a user with its arm respectively at normal contracted and extended positions.
Figure 13:
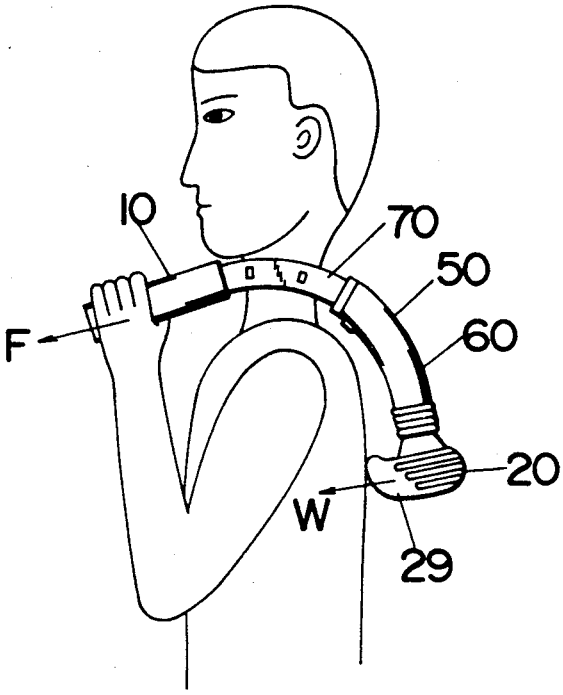
Figure 15:
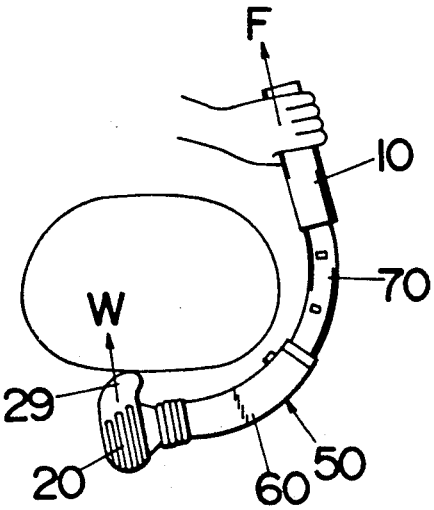
FIGS. 14 and 15 are explanatory views illustrating another operations of massaging a waist of the user with its arm respectively at normal contracted and extended positions.
Figure 14:
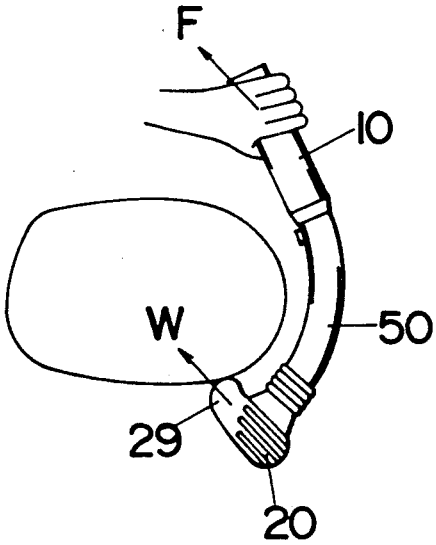

In operation, when it is required to massage the shoulder at the upper back of the user, the arm 50 is kept at the contracted position to place the applicator 20 at the desired portion while leaving the hand grip 10 in front of the shoulder to be grasped by one hand of the user, as shown in FIG. 12. At this position, in order to press the applicator 20 against the desired portion at a sufficient pressing force W, the user is only required to pull the hand grip 10 forward and downward by a force F that is substantially the same as the required pressing force W When massaging the back of the user, the arm 50 is extended so as to place the applicator 20 at the back while keeping the hand grip 10 in front of the shoulder to be grasped by one hand of the user, as shown in FIG. 13. Also at this position, the user is only required to pull the hand grip 10 forwardly by a force F in order to produce sufficient pressing force W applied to the back from the applicator 20, in much the same way as in massaging the upper shoulder shown in FIG. 12. The like procedure applies to the massaging the waist as shown in FIGS. 14 and 15. FIG. 14 illustrates a mode for massaging the right side of the waist in which arm 50 is kept contracted with the hand grip 10 kept positioned in front of the user's body to be grasped by the left hand of the user so as to apply the applicator 20 at a sufficient pressing force W simply by pulling the hand grip 10 forwardly by a force F. In FIG. 15, the arm 50 is extended for massaging the middle of the waist with the arm 50 with the hand grip 10 kept positioned in front of the user's body to be grasped by the left hand of the user so that the applicator 20 is pressed by a sufficient force W simply pulling the hand grip 10 forwardly by a force F. In this manner, the user can enjoy massaging at a portion beyond the reach of the user's arm while keeping the hand grip 10 positioned in front of the user to give sufficient pressing force at the applicator simply by pulling the hand grip forwardly in a convenient manner.

Figure 16:
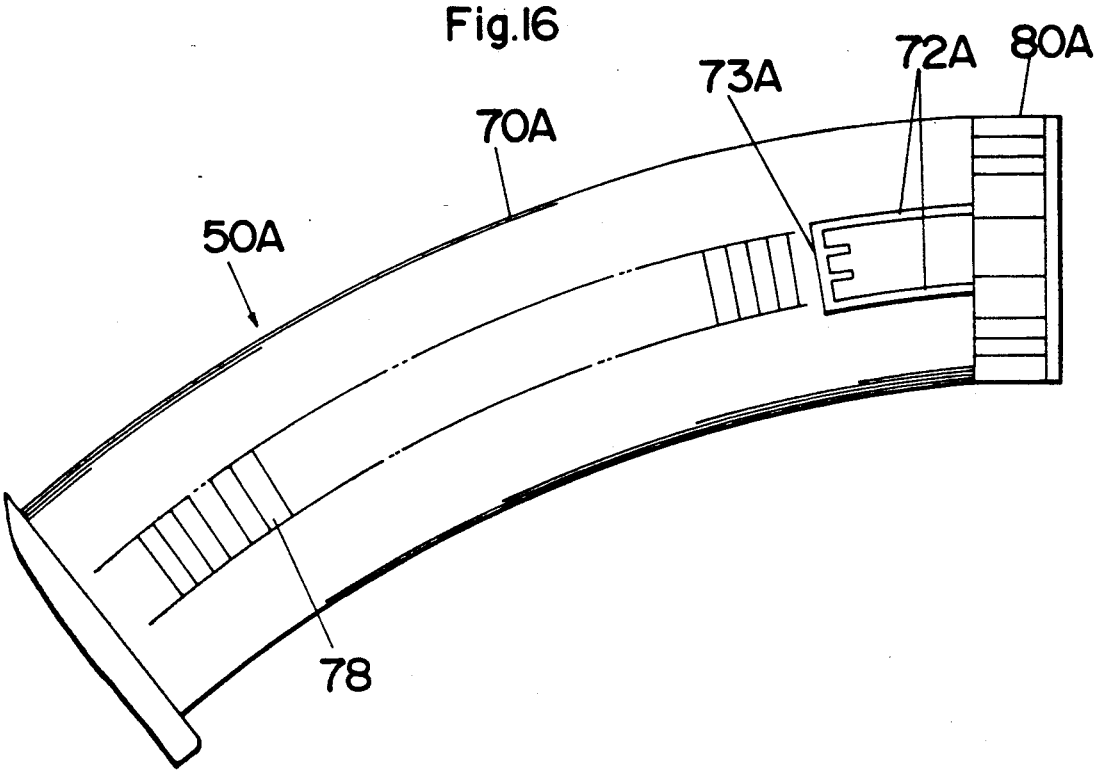
FIG. 16 is a front view of an inner tube forming an extensible arcuate arm of a modification of the first embodiment.
Figure 17:
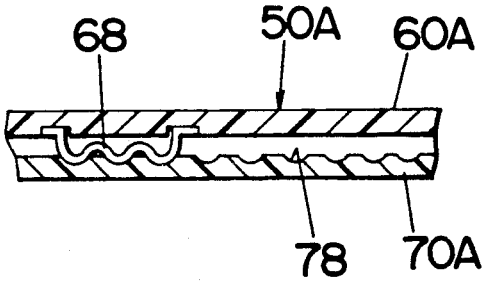
FIG. 17 is a sectional view illustrating a mechanism utilized to vary the length of the arm in the above modification.

FIGS. 16 and 17 illustrates a modification of the above embodiment in which an arcuate arm 50A is composed of an outer tube 60A and an inner tube 70A. The outer tube 60A and the inner tube 70A are respectively connected to a like applicator and a hand grip, and are telescopically coupled to each other for varying the length of the arm, as in the above embodiment. The inner tube 70A is formed in its diametrically opposed surfaces respectively with racks 78 comprising a number of teeth extending along an arcuate axis of the arm 50A. Attached on the diametrically opposed inner surfaces at the free end of the outer tube 60A are spring latches 68 with fingers. The spring latch 68 is normally biased to engage the fingers into the teeth of the rack 78 and is capable of disengaging the fingers from the rack 78 against the bias as it is forced to move along the length of the rack 78. Thus, the spring latch 68 can be slidable along the entire length of the rack 78 and be arrested at any portion thereof so as to variably adjust the length of the arm 50. A like slider ring 80A is fitted around the free end of the inner tube 70A for smoothly guiding the inner tube 70A within the outer tube 60A as in the above embodiment. Also like guide fins 72A and stopper projections 73A are formed on the inner tube 70A adjacent the slider ring 80A for prevention of relative rotation between the outer and inner tubes and for prevention of the esoape of the inner tube from the outer tube.

SECOND EMBODIMENT

Figure 18:
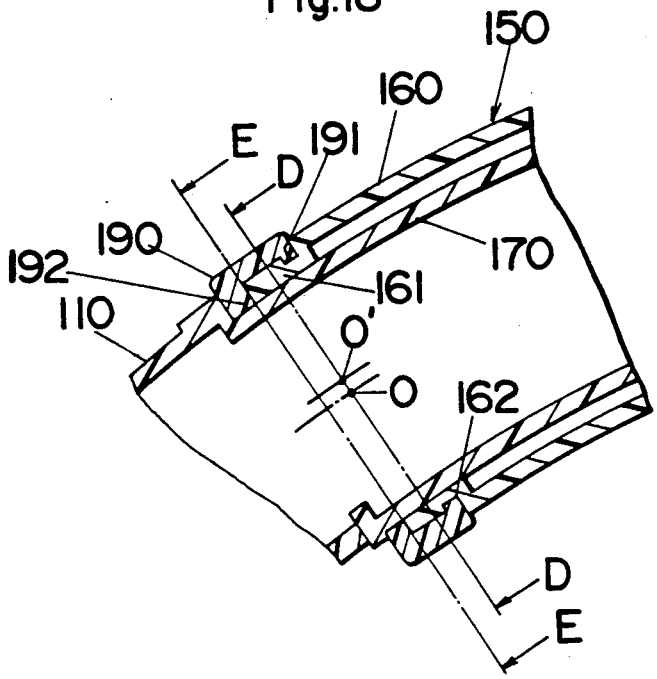
FIG. 18 is a sectional view illustrating a mechanism utilized to vary the length of an extensible arcuate arm in accordance with a second embodiment of the present invention.
Figure 19:
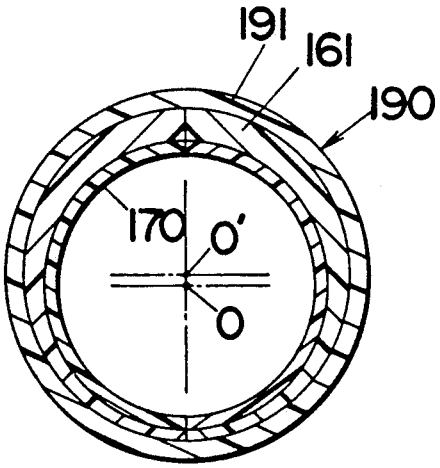
FIG. 19 is a cross section taken along line D—D of FIG. 18.
Figure 20:
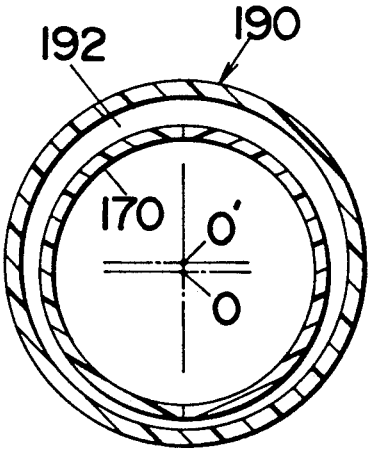
FIG. 20 is a cross section taken along line E—E of FIG. 18.
Figure 21:
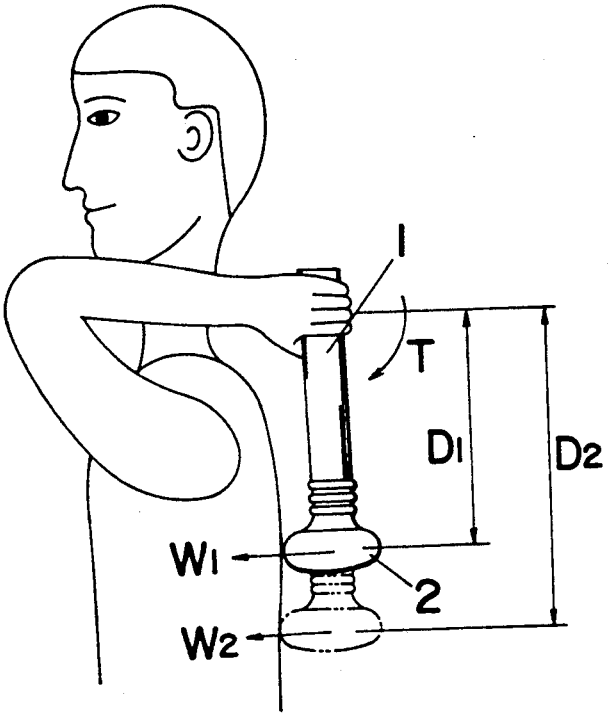
FIG. 21 is a schematic view illustrating the operation of a prior art massager.

FIGS. 18 to 20 illustrate an arouate arm 150 utilized in a hand-held massager in accordance with a second embodiment of the present invention which is similar to the first embodiment except for a mechanism of adjusting the length of the arm 150. The other configuration and operations are identical to the first embodiment and are deemed unnecessary to repeat here. The arcuate arm 150 comprises an outer tube 160 and an inner tube 170 both of circular cross-sections having an arcuately curved center axis. The inner tube 170 extends from a hand grip 110 into the outer tube 160 to be movable along the arcuate center axis, and has a circular exterior circumference centered on the arcuate center axis.

The end of outer tube 160 remote from the applicator is narrowed to define a sleeve 161 having a circular interior circumference which is centered on the arcuate center axis at O and is in slidable contact with the exterior circumference of the inner tube 170. The sleeve 161 carries a fastener ring 190 which is rotatable about the sleeve 161 with its hook 191 fitted loosely in a circumferential groove 162 in the outer surface of the sleeve 161. The end of the fastener ring 190 extends radially inwardly past the end face of the sleeve 161 to form thereat a grip flange 192 which has an inner circular perimeter in slidable contact with the exterior circumference of the inner tube 170. The inner circular perimeter of the grip flange 192 is centered on a second center axis at O' which is in eccentric relation to the center arcuate axis O such that, when the fastener ring 190 is at one angular disposition about the arcuate center axis O, as shown in FIG. 20, the grip flange 192 has its inner circular perimeter kept in loose contact with the Outer circumference of the inner tube 170, thereby allowing the fastener ring 190 to be slidable together with the sleeve 161 along the length of the inner tube 170. When the fastener ring 190 is rotated from the angular disposition of FIG. 20 in either direction, the inner circular perimeter of the grip flange 192 comes into pressed engagement against the outer circumference of the inner tube 170 for tightening the fastener ring 190 on the inner tube 170. In this manner, the outer tube 160 can be locked onto the inner tube 170 at any location along the length thereof, which makes it possible to vary the length of the arm 150 in a stepless manner.

What is claimed is:

1. A hand-held extensible vibratory massager comprising:

a hand grip to be grasped by a hand of a user, the hand grip being a straight member having a longitudinal axis;

a vibration applicator containing a vibration source and having a center axis and an applicator portion projecting radially outwardly of said center axis;

an extensible arcuate arm interconnecting said hand grip and said vibration applicator along an arcuate path defined by said arm the arrangement being such that the projecting angle of the applicator portion with respect to the longitudinal axis of the hand grip varies as the arcuate arm is extended;

said extensible arcuate arm comprises an inner arcuately elongated tube and an outer arcuately elongated tube, said inner tube being telescopically slidable within said outer arcuate tube so that said arcuate arm can vary its length along said arcuate path, said outer tube carrying an adjustor which is engageable selectively with one of a plurality of indentations formed in the surface of one of said tubes and spaced longitudinally thereof for latching said outer tube into a selective longitudinal position relative to said inner tube, said adjustor comprising a generally semi-circular member with an operator knob at its middle and opposed spring legs integrally extending from said operator knob in opposite directions, said spring legs disposed between said outer and inner tubes, said operator knob projecting outwardly through said outer tubes to be accessible by the hand of the user, said spring legs formed at their free ends respectively with shoes which are sprint biased into said indentations, each of said spring legs formed intermediate between said shoe and said operator knob with a fulcrum projection which abuts against the surface of one of said tubes such that, upon said operator knob being pushed inwardly, said spring legs are forced to pivot about said fulcrum projection to move away from the surface of the tube having said indentations, thus disengaging said shoes out of said indentations and, allowing the slidable movement of said outer tube relative to said inner tube.

2. A hand-held vibratory massager as set forth in claim 1, wherein said spring legs are each formed at a portion opposite of said fulcrum projection with a slider projection for slidable contact with the surface of the tube not having said indentations;

said tube having said indentation being formed with a plurality of ledges slightly projecting on the surface thereof at spaced locations along the length thereof in correspondence to said indentations, said slider projections brought into pressed contact with said ledges, respectively when said shoes are engaged into the indentations.

3. A hand-held vibratory massager as set forth in claim 1, wherein said tube having said indentations is formed with a plurality of ledges slightly projecting on the surface thereof at spaced locations along the length thereof in correspondence to said indentations, and wherein said adjustor further comprises a clip separate from said spring legs and carried together therewith by one fos aid tubes, said clip disposed between said inner and outer tubes to extend over a circumferential portion of said inner tube not covered by said spring legs, said clip formed integrally with slider projections which come into pressed contact with the inner surface of said outer tube and the outer surface of said inner tube respectively when said shoes are engaged into the indentations.

4. A hand-held vibratory massager as set forth in claim 2, wherein said adjustor is provided at the free end of said outer tube, and wherein said inner tube is provided at its free end with a slider ring, said slider ring extending circumferentially about said inner tube and having circumferentially spaced slide projections for sliding contact with the interior surface of said outer tube.

5. A hand-held vibratory massager as set forth in claim 4, wherein said outer tube is formed with a plurality of lands slightly projecting on the interior surface thereof at spaced locations along the length thereof in correspondence to said indentations, the slide projections of said slider ring brought into pressed contact with said lands of said outer tube, respectively when said shoes are engaged into the indentations.

6. A hand-held vibratory massager as set forth in claim 1, wherein one of said tubes is formed on its surface with a plurality of guide rails which extend along the length thereof for engagement with fins projecting from the surface of the other of said tubes so as to non-rotatively hold said inner tube within said outer tube.

7. A hand-held vibratory massager as set forth in claim 1, wherein oen fo said tubes is formed on its surface with a rack having a number of spaced teeth extending along the length thereof, the other of said tubes is provided at its free end with a spring latch which is spring biased into latching engagement with said teeth at selected portions of said rack and is capable of being disengaged therefrom against the spring bias.

8. A hand-held vibratory massager as set forth in claim 1, wherein said inner tube has a circular exterior circumference centered on a first center axis; and wherein said outer tube is provided at its free end with a sleeve which has a circular interior circumference centered commonly on said first center axis and which is in slidable contact with said exterior circumference of said inner tube, said sleeve supporting a fastener ring which is rotatable therearound and has a grip flange projecting radially inwardly to the exterior of said inner tube, said grip flange having an inner circular perimeter in slidable contact with said exterior circumference of said inner tube, said inner circular perimeter of said grip flange being centered on a second center axis which is in eccentric relation to said first center axis such that said inner circular perimeter is kept in loose contact with said outer circumference of said inner tube when said fastener ring is at one angular disposition about said first center axis for allowing said fastener ring to be slidable together with said sleeve along the length of said inner tube and that said inner circular perimeter comes into pressed engagement against said outer circumference of said inner tube when said fastener ring is rotated from said angular disposition about said first center axis for tightening said fastener ring on said inner tube to disable the sliding movement between said sleeve and the inner tube.

9. A hand-held vibratory massager as set forth in claim 1, wherein said applicator includes a side pad projecting inwardly of said arcuate path.

10. A hand-held extensible vibratory massager comprising:

a hand grip to be grasped by a hand of a user;

a vibration applicator containing a vibration source; and an extensible arcuate arm interconnecting said hand grip and said vibration applicator along an arcuate path defined by said arm;

said extensible arcuate arm comprising an inner arcuately elongated tube and an outer arcuately elongated tube, said inner tube being telescopically slidable within said outer arcuate tube so that said arcuate arm can vary its length along said arcuate path;

said outer tube carrying an adjustor which is engageable selectively with one of a plurality of indentation formed in the surface of one of said tubes and spaced longitudinally thereof for latching said outer tube into a selective longitudinal position relative to said inner tube;

said adjustor comprising a generally semi-circular member with an operator knob at its middle and opposed spring legs integrally extending from said operator knob in opposite directions, said spring legs disposed between said outer and inner tubes, said operator knob projecting outwardly through said outer tube to be accessible by the hand of the user, said spring legs formed at their free ends respectively with shoes which are spring biased into said indentations, each of said spring legs formed intermediate between said shoe and said oeprator knob with a fulcrum projection which abuts against the surface of one of said tubes such that, upon said operator knob being pushed inwardly, said spring legs are forced to pivot about said fulcrum projection to expand away from the surface of the tube having said indentations, thus disengaging said shoes out of said indentations and allowing the slidable movement of said outer tube relative to said inner tube.

11. A hand-held vibratory massager as set forth in claim 10, wherein said spring legs are each formed at a portion opposite to said fulcrum projection with a slider projection for slidable contact with the surface of the tube not having said indentations;

said tube having said indentation being formed with a plurality of ledges slightly projecting on the surface thereof at spaced locations along the length thereof in correspondence to said indentations, said slider projections brought into pressed contact with said ledges, respectively when said shoes are engaged into the indentations.

12. A hand-held vibratory massager as set forth in claim 10, wherein said tube having said indentations is formed with a plurality of ledges slightly projecting on the surface thereof at spaced locations along the length thereof in correspondence to said indentations, and wherein said adjustor further comprises a clip separate from said spring legs and carried together therewith by one of said tubes, said clip disposed between said inner and outer tubes to extend over a circumferential portion of said inner tube not covered by said spring legs, said clip formed integrally with slider projections which come into pressed contact with the inner surface of said outer tube and the outer surface of said inner tube respectively when said shoes are engaged into the indentations.

13. A hand-held vibratory massager as set forth in claim 11, wherein said adjustor is provided at an the free end of said outer tube, and wherein said inner tube is provided at its free end with a slider ring, said slider ring extending circumferentially about said inner tube and having circumferentially spaced slide projections for sliding contact with the interior surface of said outer tube.

14. A hand-held vibratory massager as set forth in claim 13, wherein said outer tube is formed with a plurality of lands slightly projecting on the interior surface thereof at spaced locations along the length thereof in correspondence to said indentations, the slide projections of said slider ring brought into pressed contact with said lands of said outer tube, respectively when said shoes are engaged into the indentations.

15. A hand-held extensible vibratory massager comprising:

a hand grip to be grasped by a hand of a user;

a vibration application containing a vibration source; and an extensible arcuate arm interconnecting said hand grip and said vibration applicator along an arcuate path defined by said arm;

said extensible arcuate arm comprising an inner arcuately elongated tube and an outer arcuately elongated tube, said inner tube being telescopically slidable within said outer arcuate tube so that said arcuate arm can vary its length along said arcuate path wherein said outer tube is formed on its interior surface with a plurality of guide rails which extend along the length thereof for engagement with fins projecting from the exterior surface of said inner tube so as to non-rotatively hold said inner tube within said outer tube.

16. A hand-held extensible vibratory massager comprising:

a hand grip to be grasped by a hand of a user;

a vibration application containing a vibration source; and an extensible arcuate arm interconnecting said hand grip and said vibration applicator along an arcuate path defined by said arm;

said extensible arcuate arm comprising an inner arcuately elongated tube and an outer arcuately elongated tube, said inner tube being telescopically slidable within said outer arcuate tube so that said arcuate arm can vary its length along said arcuate path;

said inner tube having a circular exterior circumference centered on a first center axis; and wherein said outer tube is provided at its free end with a sleeve which has a circular interior circumference centered commonly on said first center axis and which is in slidable contact with said exterior circumference of said inner tubes, said sleeve supporting a fastener ring which is rotatable therearound and has a grip flange projecting radially inwardly to the exterior of said inner tube, said grip flange having an inner circular perimeter in slidable contact with said exterior circumference of said inner tube, said inner circular perimeter of said grip flange being centered on a second center axis which is in eccentric relation to said first center axis such that said inner circular perimeter is kept in loose contact with said outer circumference of said inner tube when said fastener ring is at one angular disposition about said first center axis for allowing said fastener ring to be slidable together with said sleeve along the legnth of said inner tube and that said inner circular perimeter comes into pressed engagement against said outer circumference of said inner tube when said fastener ring is rotated from said angular disposition about said first center axis for tightening said fastener ring on said inner tube to disable the sliding movement between said sleeve and the inner tube.

* * * * *